United States Patent [19]

Beck

[11] 3,982,853

[45] Sept. 28, 1976

[54] FOLDING BOAT PROPELLER

[76] Inventor: David Walter Beck, 2257 Gaylord, Long Beach, Calif. 90813

[22] Filed: July 23, 1975

[21] Appl. No.: 598,370

[52] U.S. Cl. ..... 416/142; 416/223 R
[51] Int. Cl.[2] ..... B63H 1/24
[58] Field of Search ..... 416/142, 143, 139, 223

[56] References Cited

UNITED STATES PATENTS

| | | | |
|---|---|---|---|
| 866,369 | 9/1907 | Learnard | 416/142 |
| 1,835,284 | 12/1931 | Crowhurst | 416/142 |
| 2,198,475 | 4/1940 | Dorner | 416/142 X |
| 2,532,371 | 12/1950 | Petersen | 416/142 |
| 3,255,826 | 6/1966 | Beck | 416/142 X |
| 3,715,171 | 2/1973 | Kettner | 416/142 |
| D203,780 | 2/1966 | Beck | 416/142 X |

*Primary Examiner*—Everette A. Powell, Jr.
*Attorney, Agent, or Firm*—Fulwider, Patton, Rieber, Lee & Utecht

[57] ABSTRACT

A folding boat propeller assembly having a hub and two blades. The radially inner portion of each blade is pivoted to the hub. Upon forward movement of the boat, the blades will automatically be pivoted rearwardly into a closed folded-together position by water resistance. Upon rotation of the hub by the boat's engine, the blades pivot outwardly and forwardly to a driving position.

6 Claims, 5 Drawing Figures

FIG. 1
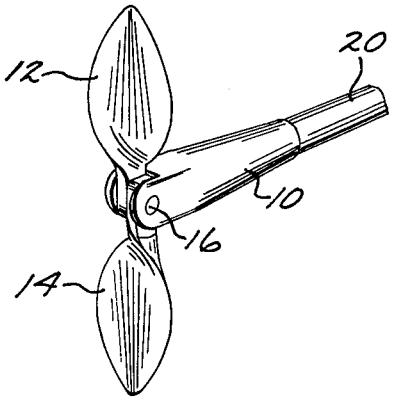
FIG. 2
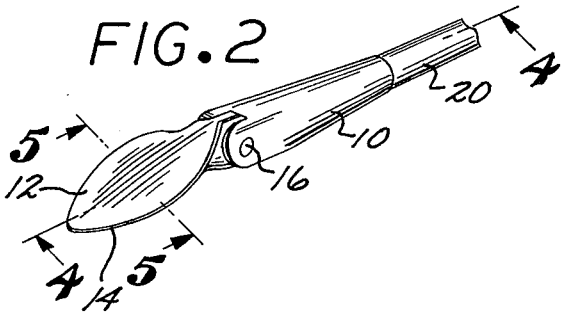
FIG. 3
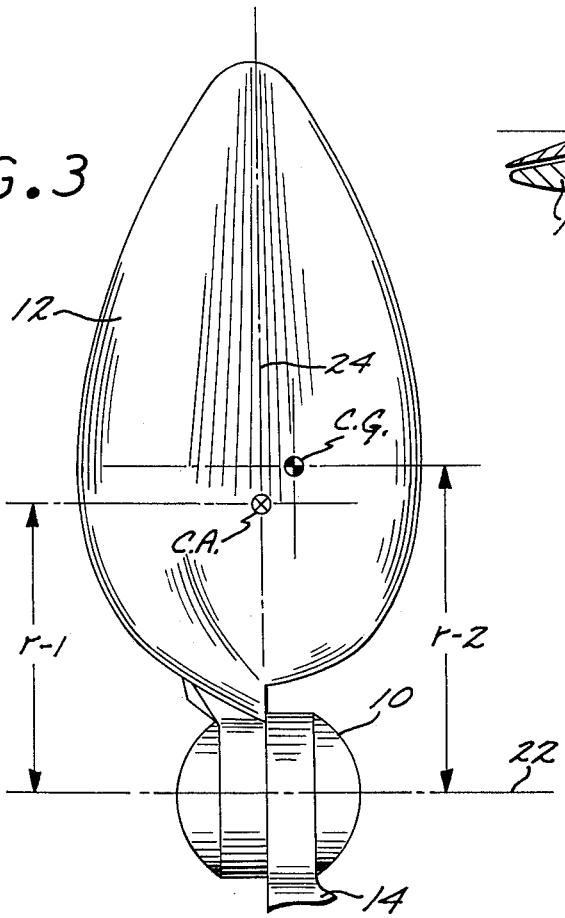
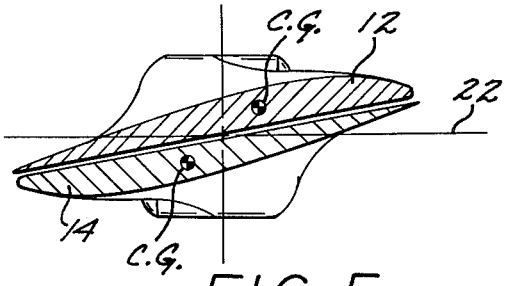
FIG. 5
FIG. 4
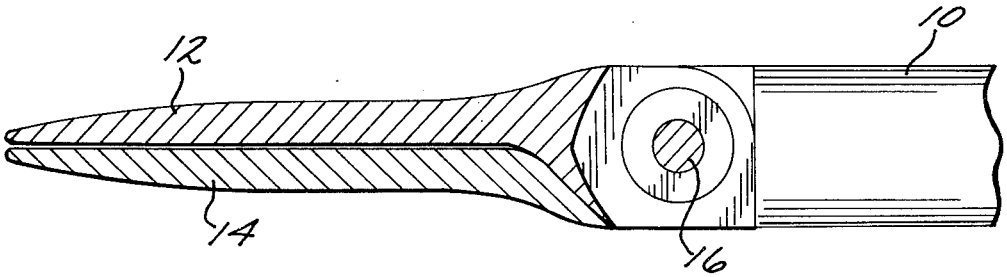

FOLDING BOAT PROPELLER

BACKGROUND OF THE INVENTION

1. Field of the Invention

The present invention relates in general to the art of boating and more particularly to an improved folding boat propeller.

2. Description of the Prior Art

Applicant is the patentee of U.S. Pat. No. 3,255,826 issued June 14, 1966. U.S. Pat. No. 3,255,826 is directed to a folding boat propeller having a hub and two blades, the radially inner portion of each blade being pivotally attached to the hub. The blades are automatically folded together to a closed position due to water resistance as the boat moves forwardly under sail. When the engine is started, hub rotation results in pivotal unfolding of the blades to an open driving position. Another folding boat propeller of this type is disclosed in U.S. Pat. No. 3,591,311 issued July 6, 1971. Although propellers of this type afford efficient operation, on occasion the blades fail to move into their open position, particularly when the engine is reversed and the boat is moving forwardly. This can result in serious consequences when the boat is being docked or moored, especially in a crowded anchorage.

SUMMARY OF THE INVENTION

As a result of considerable experimentation, and a long period of research and development applicant has discovered that the propeller blades can be caused to be moved into an open position even with the boat underway and the driveshaft rotating in reverse if the blades are so configured and weighted that the center of hydrodynamic force of each blade is positioned radially inwardly of the center of gravity of each blade.

More specifically, the applicant has determined that two primary forces act on each blade of a folding propeller of the aforedescribed nature. The first primary force is a result of the hydrodynamic forces used by the flow of water over the blade surface. The second primary force is that due to the influence of centrifugal force. Such second primary force is equal to $(w/g)\ r\ v^2$ where $w$ is the blade weight, $g$ is the acceleration of gravity, $r$ is the distance along the blade from the axis of rotation and $v$ is the angular velocity. When the propeller is rotated to produce forward thrust, both moments are in the same direction tending to open the blades, since the rotating blades tend to screw themselves open. When the engine drives the propeller in reverse, however, the hydrodynamic force moment opposes the centrifugal force moment since the rotating blades tend to screw themselves closed. Applicant discovered that in order to positively effect opening of the blades in reverse, the centrifugal moment must exceed the hydrodynamic moment. This is accomplished by positioning the center of hydrodynamic force, i.e. the center of area of each blade radially inwardly of the center of gravity of each blade when the blades are in an open position.

It is therefore a major object of the present invention to provide a folding boat propeller assembly wherein the blades will move from a closed to an open position in a positive manner during forward movement of the boat whereon such propeller is mounted with the propeller shaft rotating in reverse.

Another object of the present invention is to provide a folding boat propeller assembly of the aforedescribed nature wherein the blades will also move towards an open position simultaneously in a fool-proof manner when the engine is driving the boat forwardly.

Yet a further object of the present invention is to provide a folding boat propeller assembly of the aforedescribed nature which is simple in design and rugged of construction whereby it may afford a long and trouble-free service life.

BRIEF DESCRIPTION OF THE DRAWINGS

FIG. 1 is a perspective view showing a preferred form of folding boat propeller assembly embodying the present invention, with the blades thereof arranged in their open position;

FIG. 2 is a perspective view similar to FIG. 1, but showing the blades in a closed position;

FIG. 3 is a rear elevational view showing one of the blades of said folding boat propeller assembly in its open position;

FIG. 4 is a broken vertical sectional view taken in enlarged scale along lines 4—4 of FIG. 2; and FIG. 5 is a horizontal sectional view taken along lines 5—5 of FIG. 2.

DESCRIPTION OF THE PREFERRED EMBODIMENT

Referring to the drawings, a preferred form of folding boat propeller assembly embodying the present invention includes an elongated hub generally designated 10 and a pair of like blades 12 and 14 having their radially inner portions pivotally secured to the rear portion of hub 10 by means of a pin 16. Pivot pin 16 extends transversely to the axis of rotation of hub 10. In FIG. 1, the blades 12 and 14 are shown disposed in their open position. In this position the blades serve to drive the boat on which the propeller is mounted forwardly during rotation of a propeller shaft 20 keyed to hub 10.

Referring to FIG. 2, when the engine is stopped or declutched from the propeller drive shaft 20, water resistance due to forward movement of the boat will automatically cause the blades 12 and 14 to pivot rearwardly and inwardly to their closed position shown in this figure. This is the streamlined, low-drag sailing position. Referring again to FIG. 1, when the engine transmits rotation to the shaft 20 in either forward or reverse direction centrifugal force will cause the blades 12 and 14 to automatically pivot forwardly and outwardly into their open driving position of this figure.

Referring now to FIG. 3, there is shown one of the propeller blades 12 arranged in its open driving position. It will be noted that the center of area C.A. of the blade and, hence, the center of hydrodynamic force thereof, is positioned at a distance $r$—1 from the pivot axis 22 of the pivot pin 16. The center of area C.A. of blade 12 is also disposed on the radially extending center-line 24 of such blade. The center of gravity C.G. of blade 12 is positioned at a distance $r$—2 radially outwardly from the pivot axis 22 of pivot pin 16. Such center of gravity C.G. is also positioned on a point spaced transversely outwardly towards the front of the blade 12 relative to the center-line 24 thereof. This location of the blade's center of gravity C.G. is also shown in FIG. 5.

It is important to note that the distance $r$—1 should be less than the distance $r$—2, i.e., the center of area C.A. of the blades 12 and 14 should be spaced radially inwardly of the center of gravity C.G. thereof with respect to the pivot axis 22 of the pivot pin 16. With this arrangement, upon reverse rotation of the propeller drive shaft 20, and with the boat moving forwardly, the centrifugal force applied to the blades tending to open the blades will exceed the hydrodynamic force acting upon the blades tending to retain the blades in their closed position. Accordingly, the blades will always positively move into their open driving position when the engine rotation is reversed so as to thereby insure that forward motion of the boat will be promptly slowed.

It has been found that the center of area C.A. of each blade should be approximately 5 per cent closer to the pivot axis 22 than the center of gravity thereof in order to obtain the best results. In prior art folding boat propellers of which applicant is aware the center of blade area is generally 10 per cent farther away from pivot axis 22 than the center of gravity.

With further reference to FIG. 3 and, additionally, referring to FIG. 2, it will be noted that the blades 12 and 14 are so configured and weighted, that the center of gravity C.G. of the blades 12 and 14 is disposed transversely outwardly of the pivot axis 22, i.e., on the side of the rotational axis towards which the blades are flung when the shaft is rotated to drive the boat forwardly. Conveniently, the leading edges of the blades may be thickened to obtain this arrangement and also increase forward thrust. Accordingly, upon rotation of propeller shaft 20 in either forward or reverse, the blades 12 and 14 will always immediately pivot outwardly to their open position of FIG. 1.

From the foregoing description it will be clear that the folding boat propeller assembly of the present invention will always move into an open position during either reverse or forward rotation of the propeller shaft. It should be further noted that by positioning the maximum cord of the propeller blades closer to the axis of blade rotation than was the case with earlier folding boat propellers, a more streamlined folded propeller shape is obtainable. This affords the additional advantage of reducing the frontal area with the shaft 20 being arranged at the 10 to 18 degrees horizontal slant common to sail boat installations. A more streamlined propeller configuration is also afforded when the propeller assembly is mounted in a more horizontal configuration. A propeller assembly embodying the present invention has also been found to more nearly duplicate the power transmittal of a conventional solid boat propeller. This affords easier sizing by a buyer, since such buyer can order a folding boat propeller having the same diameter and pitch of a conventional fixed boat propeller of the same size.

Various modifications and changes may be made with respect to the foregoing detailed description without departing from the spirit of the present invention.

I claim:

1. A reversible folding boat propeller assembly having enhanced capability to open with reverse thrust when the boat is still moving forward through the water, comprising:

a hub that is rotated about a rotational axis in one direction to drive a boat in a forward direction and in a reverse direction to drive a boat in a backward direction, said hub being formed with a blade recess;

a pair of blades;

a pivot pin pivotally connecting the radially inner ends of said blades to said hub within said recess for movement about a pivot axis that intersects and is normal to said rotational axis;

each of said blades pivoting about said pivot axis and automatically moving outwardly and forwardly from a closed folded-together position to an open, driving position when said hub is power-rotated in one direction to drive the boat forward, and said blades automatically moving inwardly and rearwardly to said closed position solely under the influence of water pressure when rotation of said hub is stopped and a boat to which said hub is mounted is moving forward through the water, and when said hub is power-rotated in a reverse direction to either stop a boat's forward movement or to back a boat, each of said blades will readily pivot about said pivot axis and automatically move outwardly and forwardly from a closed folded-together position to an open, driving-position;

each of said blades being so configured and weighted that they offer a minimum drag through the water when in the closed position, but will readily move to an open position, even when a boat is still moving forward through the water with the water pressure biasing said blades to a closed position, when said hub is power-rotated in a reverse direction because the centrifugal force opening said blade is greater than the hydrodynamic force closing said blades as the center of hydrodynamic force of each blade is positioned radially inwardly of the center of gravity of said blades and closer to the pivot axis than to the outward end of said blades, and with each of said blades having its outer ends narrowed over a significant distance, its outer end thinned and its maximum chord a substantial distance in from the outer ends.

2. A folding boat propeller assembly as set forth in claim 1 wherein said blades are so configured and weighted that the center of gravity of each blade with said blades in closed position is spaced transversely outwardly of said pivot axis on the side of said rotational axis towards which the respective blades are flung when said hub is rotated.

3. A folding boat propeller assembly as set forth in claim 1 wherein the center of area of each blade is disposed approximately 5 percent closer to said pivot axis than the center of gravity of each blade.

4. A folding boat propeller assembly as set forth in claim 2 wherein the center of area of each blade is disposed approximately 5 percent closer to said pivot axis than the center of gravity of each blade.

5. A folding boat propeller assembly as set forth in claim 2 wherein the leading edges of said blades are thickened in comparison with the trailing edge portions thereof to displace the center of gravity of said blades transversely outwardly of said rotational axis.

6. A folding boat propeller assembly as set forth in claim 4 wherein the leading edges of said blades are thickened in comparison with the trailing edge portions thereof to displace the center of gravity of said blades transversely outwardly of said rotational axis.

* * * * *